US005363836A

United States Patent [19]

Briggs

[11] Patent Number: 5,363,836

[45] Date of Patent: Nov. 15, 1994

[54] FURNACE WITH SUPPLEMENTARY HEAT EXCHANGE MEANS

[75] Inventor: Eugene C. Briggs, Bowling Green, Ky.

[73] Assignee: Black Gold Corporation, Nashville, Tenn.

[21] Appl. No.: 112,702

[22] Filed: Aug. 26, 1993

[51] Int. Cl.[5] ..... F24H 3/02

[52] U.S. Cl. ..... 126/109; 126/110 R; 126/110 B; 126/116 R

[58] Field of Search ..... 126/109, 110 R, 110 B, 126/116 R

[56] References Cited

U.S. PATENT DOCUMENTS

| | | | |
|---|---|---|---|
| 3,388,697 | 6/1968 | Muckelrath | 126/109 X |
| 4,751,910 | 6/1988 | Allen et al. | 126/117 X |
| 4,794,908 | 1/1989 | Hall | 126/110 R X |
| 4,860,725 | 8/1989 | Tallman et al. | 126/110 R |
| 4,955,359 | 9/1990 | Briggs et al. | 126/110 R |

*Primary Examiner*—Larry Jones
*Attorney, Agent, or Firm*—Michael E. McKee

[57] ABSTRACT

A furnace including an elongated housing having an air intake adjacent one end of the housing and an air discharge vent adjacent the other end of the housing utilizes a substantially U-shaped heat exchanger positioned within the housing and a partition supported within the housing so as to separate the interior of the housing into first and second zones. A fuel burner assembly directs a flame and attending combustion products into one leg section of the heat exchanger so that the heat generated by the flame and combustion products are absorbed through the inside surfaces of both leg sections. The furnace also includes a fan so that a fraction of the air move through the first zone and absorbs heat from the outer surfaces of the one leg section and so that a remainder of the air moves through the second zone and absorbs heat from the other surfaces of the other leg section. The partition provides a first and a second opening through which the first and second zones communicate with one another. The remainder of the air is permitted to mix with a fraction of the air through the second opening before exiting the housing means through the discharge vent with the fraction of the air. As the remainder of air mixes with the fraction of the air within the first zone, it is permitted to flow across regions of the one leg section of the heat exchanger exposed to the highest concentration of heat generated by the flame and products.

18 Claims, 3 Drawing Sheets

FURNACE WITH SUPPLEMENTARY HEAT EXCHANGE MEANS

BACKGROUND OF THE INVENTION

This invention relates generally to fuel oil, gas or waste oil-burning furnaces and relates, more particularly, to such furnaces of a forced-air type for heating air in climate control applications.

The furnace with which this invention is concerned includes elongated housing means and a heat exchanger supported within the housing means so as to extend between opposite ends thereof. An air intake is associated with one end of the housing means, an air discharge vent is associated with the other end of the housing means, and a fan is mounted adjacent the air intake for directing air into the air intake and toward the air discharge vent so that air moving through the housing means flows along the outer surface of the heat exchanger. The heat exchanger includes a combustion chamber adjacent an inlet end of the heat exchanger disposed opposite the air intake end of the housing means and an opposite outlet end. A fuel burner assembly is supported adjacent the inlet end of the heat exchanger for burning a fuel/air mixture within the combustion chamber of the heat exchanger so that a flame and combustion products are directed axially of the heat exchanger toward the outlet end thereof and so that the air flowing through the housing means from the air intake to the air discharge vent passes along the outer surface of the heat exchanger and absorbs heat therefrom. An example furnace of this type, commonly known as a counterflow furnace, is shown and described in U.S. Pat. No. 4,955,359, the disclosure of which is incorporated herein by reference.

It is an object of the present invention to provide a new and improved furnace of the aforedescribed class.

Another object of the present invention is to provide such a furnace having an enhanced efficiency.

Still another object of the present invention is to provide such a furnace wherein the amount of heat absorbed from the heat exchanger by the air moving through the housing means is increased.

Yet another object of the present invention is to provide such a furnace which is uncomplicated in construction and effective in operation.

SUMMARY OF THE INVENTION

This invention resides in a forced-air furnace including substantially enclosed housing means having opposite first and second ends, sidewalls extending between the first and second ends and partition means extending between the first and second ends so as to separate the interior of the housing means into a first zone and a second zone. The partition means provides a first opening and a second opening through which the first and second zones are permitted to communicate with one another, and the first opening is disposed adjacent the first end of the housing means and the second opening is disposed adjacent the second end of the housing means. The housing means also includes an air intake associated with the first end and an air discharge vent associated with the second end and opening out of at least the first zone.

The furnace also includes a heat exchanger having a body including two elongated leg sections mounted within the housing means and a bridge section joining the leg sections. One of the leg sections is positioned within so as to extend along the length of the first zone and provides an inlet end for the heat exchanger body. The bridge section is positioned through the first opening provided by the partition means so as to extend between the first and second zones, and the other section is positioned within so as to extend along the length of the second zone and provides an outlet end for the heat exchanger body. A fuel burner assembly is associated with the heat exchanger body for directing a flame and attending combustion products into the inlet end of the heat exchanger body, and means are associated with the fuel burner assembly for moving the combustion products in sequence through the one leg section and then through the other leg section to the outlet end of the heat exchanger body so that the heat generated by the flame and combustion products are absorbed through the inside surfaces of the heat exchanger body.

The furnace also includes means for moving air from the air intake to the air discharge vent so that a fraction of the amount of air moved by the air moving means flows along the length of the first zone and absorbs heat from the outer surface of the one leg section of the heat exchanger body and the remainder of the amount of air moved by the air moving means flows along the length of the second zone and absorbs heat from the outer surface of the other leg section of the heat exchanger body and then is permitted to mix with the fraction of air through the second opening before exiting the housing means through the discharge vent with the fraction of the amount of air.

DETAILED DESCRIPTION OF THE ILLUSTRATED EMBODIMENT

Figure 1:
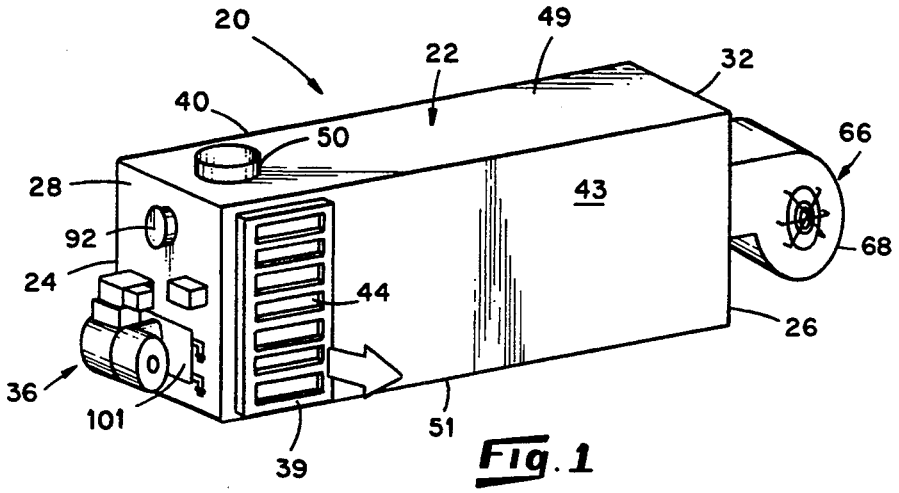
FIG. 1 is a perspective view of an embodiment of a furnace within which features of the present invention are incorporated.
Figure 2:
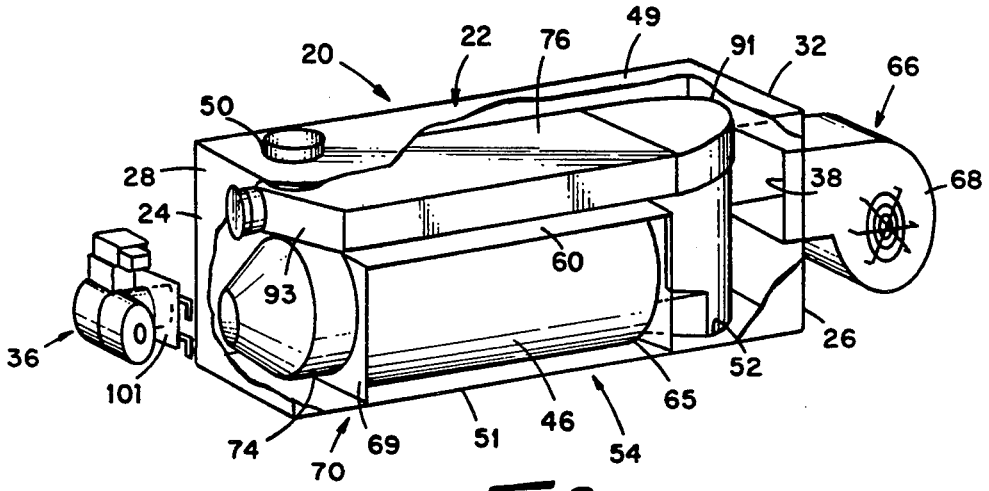
FIG. 2 is a perspective view of the FIG. 1 embodiment, shown partially cut-away.

Turning now to the drawings in greater detail and considering first FIGS. 1 and 2, there is shown an embodiment, generally indicated 20, of a forced air furnace shown operatively positioned in a room for heating the air space of the room. The depicted furnace 20 is supported from the room ceiling in a generally horizontal orientation of use and, as is explained herein, draws in room air at one end of the furnace and discharges air at the other end of the furnace at a higher temperature.

The furnace 20 includes elongated housing means 22 having two opposite ends 24, 26 and generally planar sidewalls extending between the ends 24, 26. The end 24 of the housing means 22 is covered by a planar end panel 28, and the end 26 of the housing means 22 is covered by a planar end panel 32. As will be apparent herein, the end panel 28 disposed at the end 24 of the housing means 24 provides an access opening for a burner assembly 36 of the furnace 20, and the end panel 32 provides a substantially rectangular-shaped air intake 38 for the furnace 20 through which air, i.e., room air, is forced into the interior of the housing means 22.

One of the sidewalls of the housing means 22 is provided by a panel 40, and another of the sidewalls of the housing means 22 is provided by a side panel 43. The side panel 43 includes an air discharge vent 44 adjacent the end 24 of the housing means 22 through which heated room air exits the housing means 22. In the depicted furnace 20, the air discharge vent 44 is defined by a louvered section 39 incorporated within the side panel 46. The sidewalls of the housing means 22 also includes top and bottom panels 49 and 51, respectively, positioned in a substantially parallel relationship. The top panel 49 includes a circular opening 50 adjacent the end 24 of the housing means 22, and the bottom panel 51 includes a circular opening 52 (best shown in FIG. 2) adjacent the end 26 of the housing means 22. If desired, selected ones of the end panels and the side panels can be made to be easily detachable from the remainder of the housing means 22 to provide relatively easy access to the interior thereof.

Figure 3:
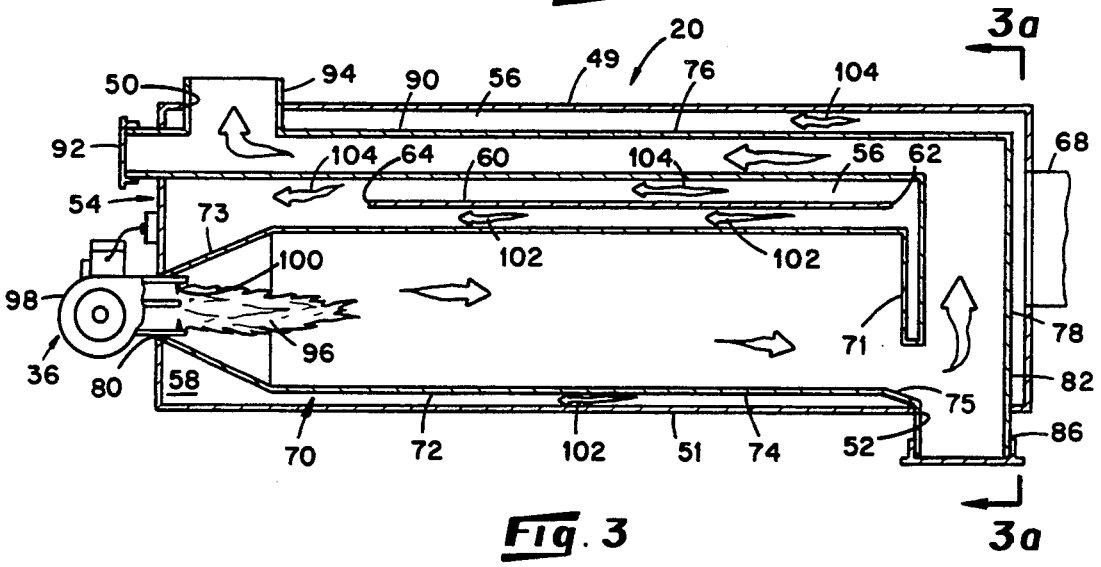
FIG. 3 is a schematic longitudinal cross-sectional view of the FIG. 1 furnace.
Figure 4:
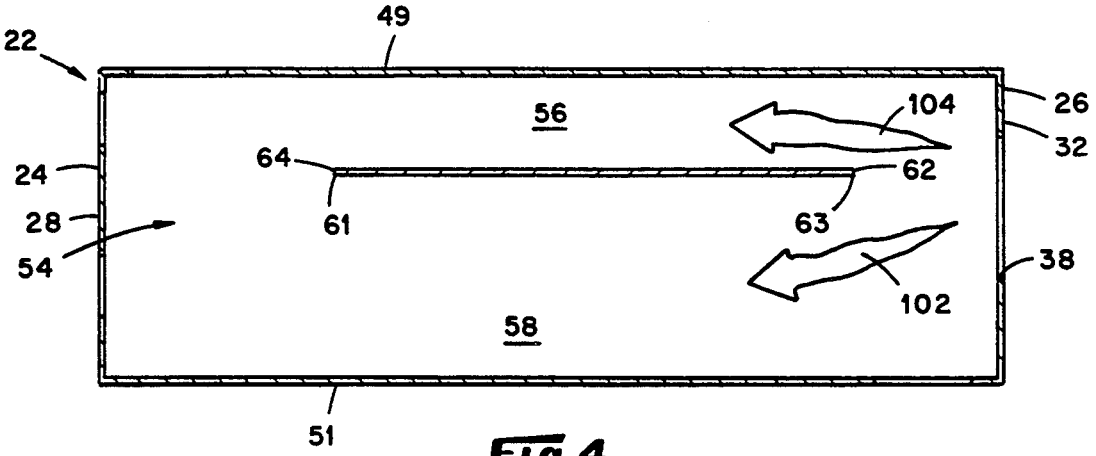
FIG. 4 is a view similar to that of FIG. 3 which schematically illustrates the housing means of the FIG. 1 furnace.

With reference to FIGS. 2–4, the housing means 22 further includes partition means, generally indicated 54, extending between the ends 24 and 26 of the housing means 22 so as to separate the interior of the housing means 22 into an upper zone 56 and a lower zone 58. In the depicted furnace 22, the partition means 54 is provided by a partition panel 60 supported in a substantially parallel relationship with the top and bottom panels 49 and 51. The partition panel 60 includes two opposite ends 61 and 63, and each of these ends 61 or 63 is spaced from a corresponding end panel 28 or 32 of the housing means. The spacing provided between the partition panel end 63 and the end panel 32 provides a first opening 62 through which the upper and lower zones 56 and 58 communicate with one another, and the spacing provided between the partition panel end 61 and the end panel 28 provides a second opening 64 through which the upper and lower zones 56 and 58 communicate with one another. The purpose of each of the first and second openings 62 and 64 will become apparent herein.

Each of the aforedescribed panels of the housing means 22 can be constructed of any of a number of suitable materials, such as sheet steel.

With reference again to FIGS. 1 and 2, the furnace 20 includes means, generally indicated 66, for moving air through the housing means 22 from the air intake 38 to the air discharge vent 44. In the depicted embodiment 20, the moving means 66 includes a centrifugal fan assembly 68 supportedly attached to the end panel 32 at the end 26 of the housing means 22 for drawing air from the surrounding room and then directing the air in sequence through the air intake 38, through the housing means 22 and out the discharge vent 44 in a manner described herein.

As best depicted in FIG. 4, the air flow which enters the housing means 22 through the air intake 38 is separated by the partition panel 60 so that a portion, or fraction (indicated by the flow arrow 102), of the amount of air which enters the air intake 38 flows through the lower zone 58 and another portion, or the remainder (indicated by the flow arrow 104), of the amount of air which enters the air intake 38 flows through the upper zone 56. The remainder 104 of air which flows through the upper zone 56 is permitted to enter the lower zone 58 and mix with the air fraction 102 through the second opening 64 before exiting the discharge vent 44 with the air fraction 102. In the depicted furnace 20, the fraction 102 of the air which flows through the lower zone 58 is believed to be about two-thirds of the total amount of air forced through the air intake 38 by the fan 68.

Figure 5:
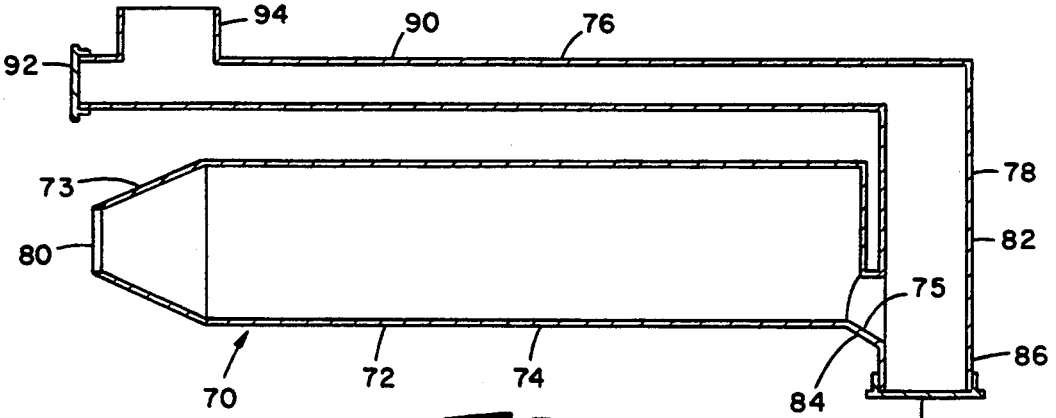
FIG. 5 is a view similar to that of FIG. 3 which schematically illustrates the heat exchanger of the FIG. 1 furnace.

With reference to FIGS. 2,3 and 5, the furnace 20 also includes a heat exchanger, generally indicated 70, having an elongated hollow body 72 operatively mounted within the housing means 22. The heat exchanger body 70 is somewhat U-shaped in form having a lower leg section 74 supported within the lower zone 58, an upper leg section 76 supported within the upper zone 56, and a bridge section 78 joining the upper and lower leg sections 74 and 76. The lower leg section 74 has an opening 80 adjacent the end 24 of the housing means 22 which provides the inlet for the heat exchanger 70 and is supported substantially centrally of the lower zone 58 by suitable struts so that the longitudinal axes of the lower zone 58 and the lower leg section 74 are coincident with one another. The portion, indicated 73, of the lower leg section 74 disposed adjacent the end 24 is somewhat frustro-conical in shape so that the diameter of the leg section 74 increases as a path is traced along the leg section 74 from the end 24. The remainder of the lower leg section 74 is substantially cylindrical in shape and extends to a flat, substantially circular end plate 71 disposed at the end thereof opposite the frustroconical portion 73. Provided adjacent the lower edge of the end plate 71 is an opening 75 which permits the interior of the lower leg section 74 to communicate with the interior of the bridge section 78.

The bridge section 78 includes a substantially cylindrical conduit 82 supported substantially vertically through the first opening 62 provided between the zones 56 and 58 so as to be positioned partly within the lower zone 58 and partly within the upper zone 56. The conduit 82 is in flow communication with the lower leg section 74 by way of a conduit section 84 joined at one end to the leg section 74 (about the opening 71) and joined at the other end to the sidewalls of the conduit 82. As best shown in FIGS. 3 and 5, the conduit 82 also includes a lower end portion 86 which extends downwardly through the circular opening 52 provided in the bottom panel 51. This lower end portion 86 is covered by a removable drip cap 88 facilitating clean-out of the conduit 82 and the heat exchanger leg section 74 and for collecting water which may accumulate in the conduit 82.

The upper leg section 76 includes a conduit 90 joined to the upper end of the conduit 82 at generally a right angle thereto and extends through the upper zone 56 so that the longitudinal axes of the upper zone 56 and the conduit 90 of the leg section 76 are generally coincident. As best shown in FIG. 3, the conduit 90 of the upper leg section 76 is substantially rectangular in cross section as a path is traced along a major, i.e., middle, section of its length and converges (at one end) to a rounded end 91 to which the conduit 82 of the bridge section 78 is attached and converges (at its opposite end) to a reduced end 93 for attachment to a circular conduit section 95. The conduit section 95 protrudes through the end panel 28 and is covered by a removable cap 92. This cap 92 provides access to the interior of the conduit 90 for purposes of cleaning the conduit 90. The upper leg section 76 also includes a discharge portion 94 joined to the conduit 90 adjacent the cap 92 so as to extend at substantially a right angle with respect to the conduit 90. In addition, the discharge portion 94 extends through the circular opening 50 provided in the top panel 49 for attachment to a discharge flue (not shown).

Each of the aforediscussed leg sections and bridge section of the heat exchanger 70 can be constructed of any of a number of suitable heat-conducting materials, such as sheet steel.

With reference again to FIGS. 1–3, the fuel burner assembly 36, introduced earlier, of the furnace 20 is supported adjacent the end 24 of the housing means 22 for introducing a flame, indicated 96 in FIG. 3, directly into the lower leg section 74 of the exchanger body 72 through the inlet opening 80. The burner assembly 36 includes an atomizing nozzle through which fuel, such as waste oil, and compressed air are routed into the lower leg section 74 for burning. An air compressor is associated with the burner assembly 36 for introducing compressed air to the nozzle, and a flame igniter is mounted adjacent the nozzle for igniting the fuel and air which exits the nozzle and thus creating the desired flame 96. Preferably, a flame retention head 100 is supported adjacent the nozzle which maintains the flame adjacent the end 24 of the housing means 22 and lowers the amount of air required for combustion to accommodate relatively small rates of air flow through the burner assembly 36.

In addition, a blower 98 is supported adjacent the compressor for moving the products of combustion resulting from the generated flame 96 in sequence through the lower leg section 74, the bridge section 78 and then through the upper leg section 76. The structure and operation of the burner assembly 36 is well-known in the art so that a more detailed description is not believed to be necessary. It should be noted, however, that the depicted fuel burner assembly 36 is mounted as a single assembly upon an access door 101 which, in turn, is hingedly attached to the end panel 28. By hingedly moving the burner assembly 36 relative to the end panel 28 between its operative position adjacent the inlet opening 80 of the heat exchanger 70 and a non-operative situated to one side of the inlet opening 80, access is provided to the interior of the leg section 72 for cleaning purposes.

During operation of the burner assembly 36, the flame 96 and attending combustion products generate heat which is absorbed by so as to increase the temperature of the inside surfaces of each of the lower leg section 74, the bridge section 78 and upper leg section 76. Due, at least in part, to the proximity to the flame 96, the surface of the conical portion 73, and in particular, the upper one-half of the conical portion 73, and the regions of the cylindrical portion of the leg section 74 situated closest the conical portion 73 are exposed to the largest concentration of heat generated in the heat exchanger 70. As the combustion products continue to give up heat to the inside surfaces of the heat exchanger 70 as the products flow in sequence through the remainder of the lower leg section 74, the bridge section 78 and the upper leg section 96, the surface temperatures of the heat exchanger 70 generally decrease as a path is traced therethrough from the conical portion.

The operation by which room air is heated in the furnace 20 may best be explained with reference to FIG. 3. As mentioned earlier, the fan 68 of the furnace 20 forces air into the housing means 22 by way of the air intake 38. A fraction 102 of the amount of air forced through the air intake 38 moves axially through the lower zone 58 along the length of the lower leg section 74 before exiting the housing means 22 through the discharge vent 44 (FIG. 1). The remainder 104 of the amount of air forced through the air intake 38 moves axially along the length of the upper leg section 76 before entering the lower zone 56 through the partition panel passageway 64 and then exiting the housing means 22 through the discharge vent 44 with the aforementioned fraction 102 of air. Meanwhile, the flame 96 and combustion products introduced into the conical portion 73 of the lower leg section 72 create heat which is absorbed along the length of the heat exchanger 70, i.e., the lower leg section 74, the bridge section 78 and the upper leg section 74.

Figure 3A:
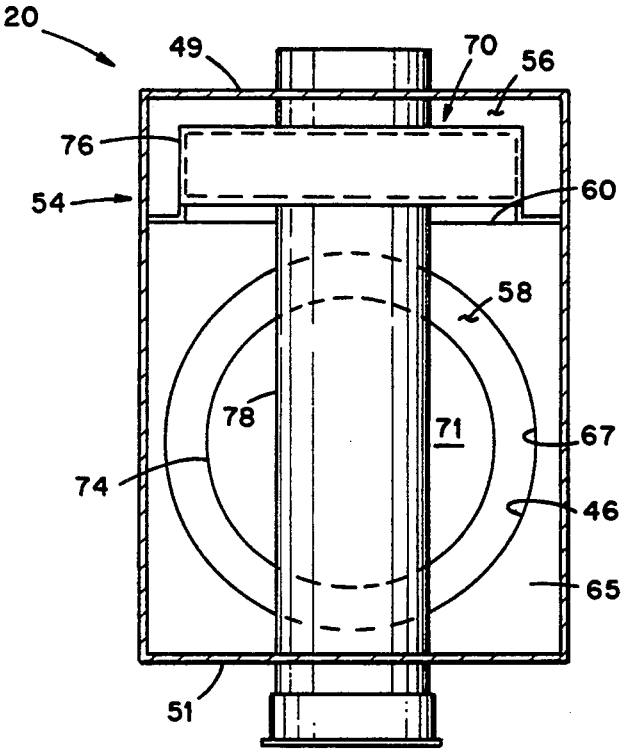
FIG. 3*a* is a transverse cross-sectional view of the FIG. 1 furnace taken generally along line 3*a*—3*a* of FIG. 3.

As best shown in FIG. 2, a major portion of the lower leg section 74 is surrounded by a protective heat shield 46. In the depicted embodiment 20, the heat shield 46 is circular in form and is supported within the housing means 22 in substantially a concentric relationship with the cylindrical, i.e., middle, portion of the lower leg section 74. Plates 69, 65 (FIGS. 2 and 3*a*) having central openings therein are positioned adjacent the ends of the heat shield 46 and support the heat shield in its concentric relationship with the lower leg section 74. Moreover, the plates 69, 65 block off so as to prevent air from flowing through the space between the side and bottom panels 40, 43, 49 and the outer surface of the heat shield 46. Therefore and with reference to FIG. 3*a*, the heat shield 46 provides, with the leg section 74, a ring-like passageway 67 through which the air fraction 102 (FIG. 3) must travel as it is urged through the lower zone 58.

As the fraction 102 of air is moved through the lower zone 58, the fraction 102 absorbs heat from the outer surfaces of the bridge section 78 and from the outer surfaces of the lower leg section 74. Thus, by the time the fraction 102 of air reaches the discharge vent 44, the temperature of the remainder 104 has been elevated by a considerable amount. Similarly, as the remainder 104 of air is moved through the upper zone 56, the remainder 104 absorbs heat from the upper portion of the bridge section 78 and from the outer surfaces of the upper leg section 76. However, due to the distance (as measured along the flow path of combustion products through the heat exchanger 70) between the upper leg section 76 and the conical portion 73, the outer surfaces of the upper leg section 76 normally do not reach as high a temperature level as does the surfaces of the lower leg section 74. Consequently, the remainder 104 of air which flows through the upper zone 56 before being permitted to mix with air fraction 102 through the second opening 64 is not as high as is the temperature of the fraction 102 of air by the time the air fraction 102 has moved along the length of the lower zone 58 and reaches the second opening 64.

The furnace 20 and its aforedescribed system for routing the air flow through two zones of the housing means 22 is advantageous in that the hottest regions of the heat exchanger body 60 (i.e., the conical portion 73 and the adjacent regions of the lower leg section 74) which are exposed to the greatest concentration of heat from the flame 96 and combustion products is also exposed to the remainder amount 104 of air which is permitted to enter the lower zone 58 through the second opening 64. Due to the exposure of this (cooler) remainder amount 104 of air to the heated outer surfaces of the conical section 73 and the adjacent regions of the lower leg section 74, heat can be absorbed by the air remainder 104 at a greater rate than it would if exposed solely to the (hotter) air fraction 104. Such an absorption of heat by the air remainder 104 is believed to be partly responsible for the obtaining and maintenance of high efficiency levels of the furnace 20.

The aforedescribed furnace 20 has been found to provide an increased efficiency of between about 8.0 to 10.0 percent when compared to the efficiency of comparable furnaces which do not possess the dual flow arrangement provided by the structure of the furnace 20. In addition, the rounded surfaces provided by the bridge section 78 and the rounded end 91 of the upper leg section 76 provide a streamlined, rather than flat, design around which air which is moved through the intake 38 by the fan assembly 68 is forced to flow. This streamlined design adjacent the housing means end 26 and the aforedescribed dual flow design of the furnace 20 enables the operating temperatures of the heat exchanger 70 to be maintained at relatively low levels along the entire length of the heat exchanger body 72. This permits the heat exchanger 70 to be constructed out of lower cost materials than would normally be required to purchase materials which are resistant to high temperature levels. For example, aluminized steel may be used, rather than higher priced stainless steel.

Moreover, the lower operating temperatures of the heat exchanger 70 reduce the likelihood of burn out of the heat exchanger components and contribute to a relatively low temperature at the discharge portion 94 of the upper leg section 76, and thus enable the furnace 20 to meet current regulations requiring that the stack temperature of the furnace not exceed a predetermined (low) temperature, e.g. about 575° F. Moreover, the design of the furnace 20 prevents the formation of condensate within its heat exchanger 70. Still further, a flue system used with the furnace 20 need not be double-walled, and thus can be less costly.

It follows from the foregoing that the aforedescribed furnace 20 accomplishes its intended objectives. The furnace 20 is highly efficient and its heat exchanger 70 operates at relatively low temperatures. Yet further, the furnace 20 is designed to provide an easily cleanable unit for use when burning waste oil or the like which normally contains dirty or ash-producing products of combustion. Along these lines, the elongated configuration of each of the upper and lower leg sections 74, 76 and the accessibility of these sections 74, 76 through the housing end panel 26 enable dirt, soot or the like to be through the leg sections with a long-handled cleaning tool and into the bridge section 78 for collection in the drip cap 88.

Figure 6:
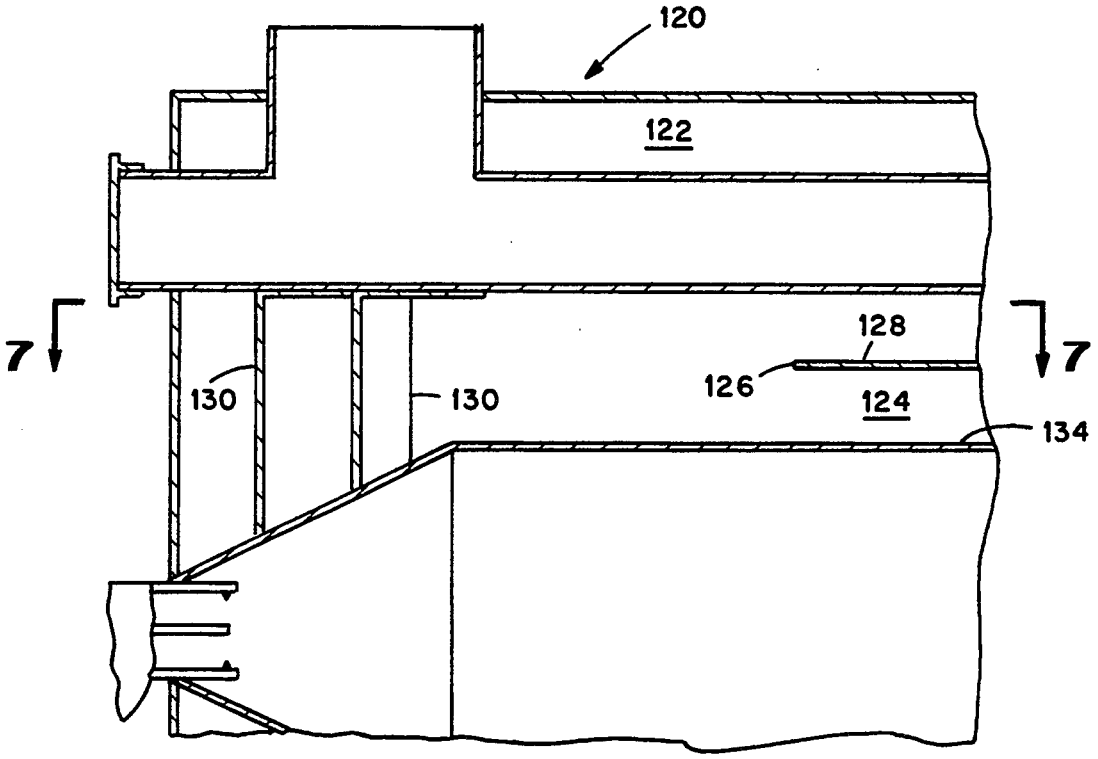
FIG. 6 is a longitudinal cross-sectional view of a fragment of an alternative embodiment of a furnace.
Figure 7:
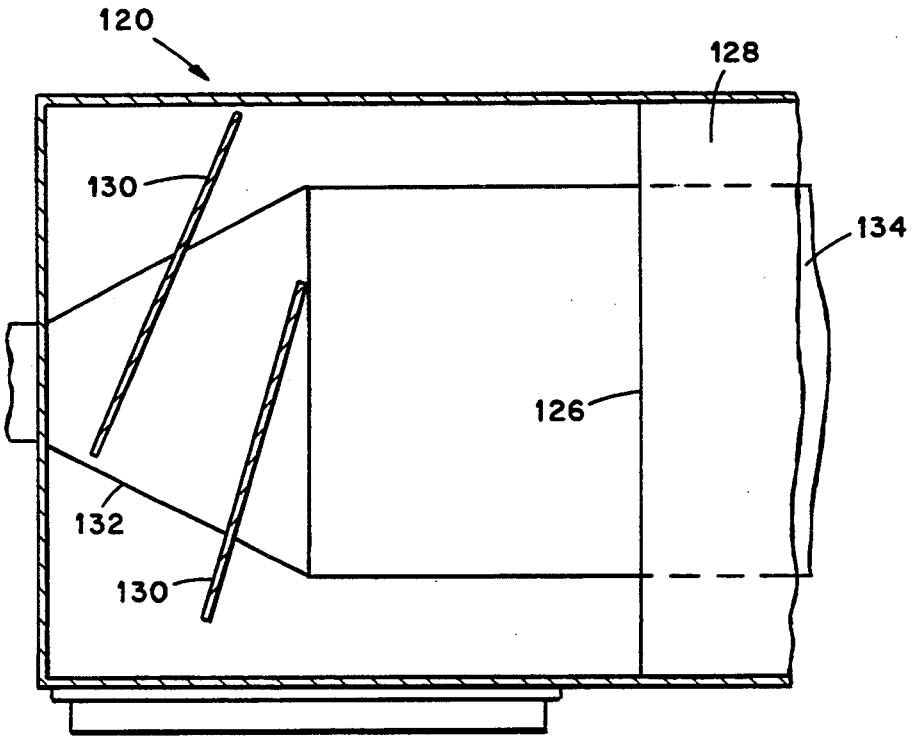
FIG. 7 is a cross-sectional view of the FIG. 6 furnace taken along line 7—7 of FIG. 6.

It will be understood that numerous modifications and substitutions can be had to the aforedescribed embodiment without departing from the spirit of the invention. For example, although the aforedescribed furnace 20 has been shown and described as being devoid of baffles or similar means for diverting the flow of air moving through the housing means or the flow combustion products moving through the heat exchanger, a furnace in accordance with the broader aspects of this invention may possess such baffles. For example, there is shown in FIG. 6 and 7 a furnace 120 having an upper zone 122 and a lower zone 124 being in communication with one another through an opening 126 provided adjacent one end of a partition panel 128. The furnace 120 also includes a series of elongated, plate-like baffles 130 attached to the underside of the upper leg section, indicated 136, of the furnace heat exchanger 134 adjacent the opening 126. The amount (i.e., the remainder amount) of air which is permitted to enter the lower zone 124 through the opening 126 is dispersed by the baffles 130 in a manner which improves the distribution of the air flow over the conical portion, indicated 132, and adjacent regions of the furnace heat exchanger 134. Accordingly, the aforedescribed embodiment is intended for the purpose of illustration and not as limitation.

What is claimed is:

1. A furnace comprising:

substantially enclosed housing means having opposite first and second ends, sidewalls extending between the first and second ends, and partition means extending between the first and second ends so as to separate the interior of the housing means into a first zone and a second zone, the partition means providing a first and a second opening within the housing means through which the first and second zones are permitted to communicate with one another wherein the first opening is disposed adjacent the first end of the housing means and the second opening is disposed adjacent the second end of the housing means, the housing means also including an air intake associated with the first end and an air discharge vent associated with the second end and opening out of the at least the first zone;

a heat exchanger having a body including two elongated leg sections mounted within the housing means and a bridge section joining the leg sections, one of the leg sections being positioned within so as to extend along the length of the first zone and providing an inlet for the heat exchanger body, the bridge section being positioned through the first opening so as to extend between the first and second zones, and the other leg section being positioned within so as to extend along the length of the second zone and providing an outlet end for the heat exchanger body;

a fuel burner assembly associated with the heat exchanger body for directing a flame and attending combustion products into the inlet end of the heat exchanger body and means for moving the combustion products in sequence through the one leg section then through the other leg section to the outlet end of the heat exchanger body so that the heat generated by the flame and combustion products are absorbed through the inside surfaces of the heat exchanger body; and means for moving air from the air intake to the air discharge vent so that a fraction of the amount of air moved by the air moving means flows along the length of the first zone and absorbs heat from the outer surface of the one leg section of the heat exchanger body and the remainder of the amount of air moved by the air moving means flows along the length of the second zone, absorbs heat from the outer surface of the other leg section of the heat exchanger body and then is permitted to mix with the fraction of the amount of air through the second opening before exiting the housing means through the air discharge vent with the fraction of the amount of air.

2. The furnace as defined in claim 1 wherein the one leg section of the heat exchanger body includes a predetermined region having a surface area to which the remainder of the amount of air is exposed as the remainder of air flows through the second opening and mixes with the fraction of the amount of air in the first zone, and the surface area of the predetermined region is situated adjacent the fuel burner assembly for absorbing a substantial portion of the heat generated by the flame and attending combustion products.

3. The furnace as defined in claim 2 wherein the one leg section of the heat exchanger body has a portion of enlarged cross section disposed adjacent the inlet end of the heat exchanger body and which is exposed to a relatively large concentration of heat generated by the flame and combustion products and the surface area of the predetermined region is provided by a surface of the portion of enlarged cross section.

4. The furnace as defined in claim 2 wherein the two leg sections of the heat exchanger body are of such a configuration so that during furnace operation, more of the heat generated by the flame and combustion products is absorbed by the one leg section than by the other leg section so that the remainder of the air which is permitted to enter the first zone through the second opening is lower than the temperature of the fraction of the amount of air moving through the first zone adjacent the passageway.

5. The furnace as defined in claim 1 wherein the air discharge vent of the housing means has one section which opens out of the first zone and another section which opens out of the second zone.

6. The furnace as defined in claim 1 wherein the bridge section of the heat exchanger extends generally across the air intake of the housing means so that air moved into the housing means by the air moving means flows across the outer surfaces of the bridge section before being separated by the partition means into the fraction and the remainder of the amount of air.

7. The furnace as defined in claim 6 wherein the outer surfaces of the bridge section are configured with a relatively streamlined form with respect to the movement of air through the housing means to facilitate the flow of air past the bridge section.

8. The furnace as defined in claim 1 wherein the heat exchanger body is generally U-shaped in form with the one leg section providing one leg of the U and the other leg section providing the other leg of the U.

9. The furnace as defined in claim 1 wherein the air discharge vent is provided by an opening defined in one sidewall of the housing means, and the partition means and the opening-defining sidewall are disposed at substantially a right angle to one another.

10. A furnace comprising:

substantially enclosed housing means having opposite first and second ends, sidewalls extending between the first and second ends, a partition extending through the interior of the housing means so as to separate the interior of the housing means into a first zone and a second zone, an air intake associated with the first end of the housing means, and an air discharge vent opening out of at least the first zone of the housing means adjacent the second end thereof, the partition providing first and second openings through which the first and second zones are permitted to communicate with one another and wherein the first opening is disposed adjacent the first end of the housing means and the second opening is disposed adjacent the second opening of the housing means;

means for moving air from the air intake to the air discharge vent so that a fraction of the amount of air moved into the air intake by the air moving means flows through the first zone and out of the housing means through the discharge vent and the remainder of the amount of air moved into the air intake by the air moving means flows through the second zone and is then permitted to mix with the fraction of the amount of air through the second opening before exiting the housing means through the discharge vent with the fraction of the amount of air;

a heat exchanger including a generally U-shaped hollow body having two leg sections and a bridge section extending between the two leg sections at one end of the U, the heat exchanger body having an inlet opening into an end of one leg section of the heat exchanger body opposite the bridge section and an outlet opening out of an end of the other leg section of the heat exchanger body opposite the bridge section, the heat exchanger body being supported within the housing means so that one leg section of the heat exchanger body is disposed within the first zone, the other leg section of the heat exchanger is disposed within the second zone, and the bridge section is disposed within the first opening of the partition and so that the fraction of the air moved by the air moving means flows along the length of the one leg section and so that the remainder of the air moved by the air moving means flows along the length of the other leg section; and a fuel burner assembly associated with the heat exchanger body for directing a flame and attending combustion products into the inlet of the heat exchanger body and means for moving the combustion products in sequence through the one leg section and then through the other leg section so that the inner sections of the two leg sections absorb heat generated by the flame and combustion products and so that each of the fraction and the remainder of the amount of air which flow through a corresponding one of the first and second zones is heated by the outer surfaces of a corresponding one of the leg sections of the heat exchanger body.

11. The furnace as defined in claim 10 wherein the one leg section of the heat exchanger body includes a predetermined region having a surface area to which the remainder of the amount of air is exposed as the remainder of air flows through the second opening and mixes with the fraction of the amount of air in the first zone, and the surface area of the predetermined region is situated adjacent the fuel burner assembly for absorbing a substantial portion of the heat generated by the flame and attending combustion products.

12. The furnace as defined in claim 11 wherein the one leg section of the heat exchanger body has a portion of enlarged cross section disposed adjacent the inlet end of the heat exchanger body and which is exposed to a relatively large concentration of heat generated by the flame and combustion products and the surface area of the predetermined region is provided by a surface of the portion of enlarged cross section.

13. The furnace as defined in claim 11 wherein the two leg sections of the heat exchanger body are of such a configuration so that during furnace operation, more of the heat generated by the flame and combustion products is absorbed by the one leg section than by the other leg section so that the remainder of the air which is permitted to enter the first zone through the second opening is lower than the temperature of the fraction of the amount of air moving through the first zone adjacent the passageway.

14. The furnace as defined in claim 10 further including air baffle means supported within the housing means for enhancing the distribution of the remainder of the air which is permitted to enter the first zone through the second opening.

15. The furnace as defined in claim 10 wherein the bridge section of the heat exchanger extends generally across the air intake of the housing means so that air moved into the housing means by the air moving means flows across the outer surfaces of the bridge section before being separated by the partition means into the fraction and the remainder of the amount of air.

16. The furnace as defined in claim 15 wherein the outer surfaces of the bridge section are configured with a relatively streamlined form with respect to the movement of air through the housing means to facilitate the flow of air past the bridge section.

17. The furnace as defined in claim 10 wherein the air discharge vent is provided by an opening defined in one sidewall of the housing means, and the partition means and the opening-defining sidewall are disposed at substantially a right angle to one another.

18. The furnace as defined in claim 10 wherein the air discharge vent of the housing means has one section which opens out of the first zone and another section which opens out of the second zone.

* * * * *